US010316845B2

(12) United States Patent
Kado et al.

(10) Patent No.: US 10,316,845 B2
(45) Date of Patent: Jun. 11, 2019

(54) OIL SUPPLY TYPE COMPRESSOR

(71) Applicant: Hitachi Industrial Equipment Systems Co., Ltd., Chiyoda-ku, Tokyo (JP)

(72) Inventors: Tomoyuki Kado, Tokyo (JP); Ryusuke Oshiro, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 175 days.

(21) Appl. No.: 15/027,836

(22) PCT Filed: Aug. 5, 2014

(86) PCT No.: PCT/JP2014/070536
§ 371 (c)(1),
(2) Date: Apr. 7, 2016

(87) PCT Pub. No.: WO2015/052981
PCT Pub. Date: Apr. 16, 2015

(65) Prior Publication Data

US 2016/0245289 A1 Aug. 25, 2016

(30) Foreign Application Priority Data

Oct. 10, 2013 (JP) ..... 2013-213050

(51) Int. Cl.
*F04C 29/12* (2006.01)
*F04C 29/02* (2006.01)
*F04C 18/16* (2006.01)

(52) U.S. Cl.
CPC ..... *F04C 29/026* (2013.01); *F04C 18/16* (2013.01); *F04C 29/12* (2013.01)

(58) Field of Classification Search
CPC ..... F04C 29/026; F04C 18/16; F04C 29/12; Y10T 137/7847; Y10T 137/7848; F04B 49/022
See application file for complete search history.

(56) References Cited

U.S. PATENT DOCUMENTS 2,318,962 A * 5/1943 Parker ..... F16K 15/026 137/513.3
3,860,363 A * 1/1975 Silvern ..... F04B 39/0207 417/12

(Continued)

FOREIGN PATENT DOCUMENTS

CN 1165249 A 11/1997
JP 57-5581 A 1/1982

(Continued)

OTHER PUBLICATIONS

Machine Translation of JP 5-296174 which is the Kobe reference listed in Applicant's IDS.*

(Continued)

*Primary Examiner* — Peter J Bertheaud
*Assistant Examiner* — Dnyanesh G Kasture
(74) *Attorney, Agent, or Firm* — Crowell & Moring LLP

(57) ABSTRACT

The invention is directed to reducing pressure-reduction time while preventing foaming in an oil-separation device during capacity control of a compressor, and to avoid startup congestion. This oil-supply-type compressor includes a main body, an oil-separation device, and an air-discharge passage for discharging compressed air during capacity control of the compressor. The air-discharge passage includes passages having large and small flow volumes, and when compressed air is discharged from the passage to the atmosphere during capacity control, the pressure in the oil-separation device is discharged using the large-flow-volume passage, until the pressure reaches or falls below a restarting-possible pressure, which is the pressure at which startup congestion does not occur when the compressor main body is restarted. When the pressure in the oil separation device reaches a prescribed pressure, which is less than or equal to the restarting-possible pressure and higher than a (Continued)

foaming pressure, the pressure is discharged using the small-flow-volume passage.

2 Claims, 3 Drawing Sheets

(56) References Cited

U.S. PATENT DOCUMENTS

| | | | | |
|---|---|---|---|---|
| 6,102,665 | A * | 8/2000 | Centers | F04B 49/10 417/17 |
| 6,655,405 | B2 * | 12/2003 | Hollister | E21B 34/02 137/102 |
| 2001/0026762 | A1 * | 10/2001 | Fujita | F04B 27/1804 417/295 |
| 2009/0308471 | A1 * | 12/2009 | Heimonen | F04C 18/16 137/624.27 |

FOREIGN PATENT DOCUMENTS

| | | | |
|---|---|---|---|
| JP | 5-296174 | A | 11/1993 |
| JP | 2001-27192 | A | 1/2001 |

OTHER PUBLICATIONS

Machine Translation of JP 2001-27192 which is the Hitachi reference listed in Applicant's IDS.*

International Search Report (PCT/ISA/210) issued in PCT Application No. PCT/JP2014/070536 dated Oct. 28, 2014 with English-language translation (two (2) pages).

Japanese-language Written Opinion (PCT/ISA/237) issued in PCT Application No. PCT/JP2014/070536 dated Oct. 28, 2014 (four (4) pages).

Chinese-language Office Action issued in counterpart Chinese Application No. 201480055075.8 dated Jan. 3, 2017 with English translation (Ten (10) pages).

* cited by examiner

OIL SUPPLY TYPE COMPRESSOR

TECHNICAL FIELD

The present invention relates to an oil supply type compressor equipped with an oil separation device and an air release path, and more particularly, to an oil supply type compressor configured to prevent foam from being formed in oil (foaming) when releasing compressed air inside an oil separation device.

BACKGROUND ART

An oil supply type compressor is known that uses oil to produce compressed air for the principal purpose of cooling of air in the compressor, sealing-off of a compressing chamber and lubrication of the compressor and/or the like.

Compressed air compressed to a predetermined pressure inside a compressor body of the oil supply type compressor is mixed with lubricating oil and discharged. Then, after the compressed air and the lubricating oil are separated from each other by an oil separation mechanism (primary separation) and an oil separator (secondary separation) which are located in an oil tank forming a part of an oil separation device, the compressed air is delivered outside from the compressor to be supplied to a use site of the user.

The separation of lubricating oil from compressed air is often performed in two steps, primary separation and secondary separation. In many instances, the primary separation uses centrifugal force on or collision of the lubricating oil in the oil tank to separate the lubricating oil from the compressed air, and the secondary separation uses a filtering element to separate the lubricating oil from the compressed air.

In contrast, the lubricating oil thus separated is temporarily stored in the oil tank. Then, the lubricating oil is cooled by a cooler and then re-supplied into the compressor body for circulation.

When the amount of air usage of the user is reduced to reach a predetermined pressure (specification pressure), capacity control of the compressor is performed to stop the supply of compressed air. The capacity control includes the following controls to achieve a reduction in power of the oil supply type compressor (reduction in power consumption).

(1) An intake throttle valve on the inlet side of the compressor is closed, and the compressor body is shut down by stopping the motor. At this stage, the compressed air after flowing through the oil separator is released through an air release path into the atmosphere to reduce the pressure inside the oil separator and the oil tank to atmospheric pressure or nearly to atmospheric pressure. Then, upon reduction in the compressed air pressure on the user side to a predetermined pressure, the operation of the compressor body is re-started, the intake throttle valve is open, and the air release path is closed for the resumption of compression.

In this regard, for restarting the operation of the compressor body, a shorter time from the shutdown of the compressor body to a restart causes startup stall due to residual pressure inside the oil separator at restart because the pressure inside the oil separator (likewise inside the oil tank) does not reduce to reach the atmospheric pressure. Since a predetermined time period is required for reducing the pressure inside the oil separator, the limited time until a restart is enabled is provided in order to prevent the startup stall from taking place due to the residual pressure inside the oil separator at restart. The capacity control will be hereinafter referred to as "automatic stopping control".

(2) Without a motor shutdown, while the operation of the compressor body is maintained, the intake throttle valve on the inlet side of the compressor is closed, and the compressed air after passing through the oil separator is released through the air release path into the atmosphere to reduce the operation pressure of the compressor (outlet pressure). Then, upon reduction in the compressed air pressure on the user side to a predetermined pressure, the intake throttle valve is open, and the air release path is closed to resume the supply of the compressed air to the user. The capacity control will be hereinafter referred to as "no-load operation control".

The compressor body is shut down in the above-described automatic stopping control (1). On this account, the automatic stopping control produces greater effects of reducing the compressor power than the no-load operation control (2). However, if the amount of compressed air consumed by the user is largely varied (large load changes), then the operation of the compressor is repeatedly stopped for a short time, resulting in an increase in burden on the motor driving the compressor body. When the limited time until the restart is enabled is provided, the amount of compressed air supplied to the user may possibly not be adequate. Given these circumstances, when the amount of compressed air consumed by the user is greatly varied and the motor is stopped at high frequency, switching to the no-load operation control (2) is typically made.

In the capacity controls (1) and (2), the pressure in the oil separation device including the oil tank and the oil separator is reduced below the pressure on the user side (pressure in a reservoir for holding the compressed air), so that a check valve is installed downstream of the oil separator in order to prevent backflow of the compressed air from the user side toward the oil separator.

In each capacity control (1), (2), the compressed air after passing through the oil separator is released through the air release circuit into the atmosphere. The air release circuit includes air-release piping connecting the downstream end of the oil separator and the atmosphere to each other, in which a pressure of the compressed air on the user side is detected, and when the pressure reaches a maximum value, the solenoid valve installed in the air release piping is opened to release the compressed air passing through the oil separator into the atmosphere.

In any of the automatic stopping control and the no-load operation control, the air release circuit is typically a single circuit shared between them. The adjustment of time required for air release is made by using an orifice and/or the like provided in the air release circuit to adjust the flow rate of released air.

In the capacity control, it is desired to shorten, as much as possible, the length of time required for a reduction of the pressure inside the oil separator to the atmospheric pressure (pressure drop time period). The reasons for this is that, in the automatic stopping control, the limited time to the subsequent restart can be shortened by shortening the pressure drop time period, so that a swift supply of the compressed air is enabled in response to the load changes on the user side. Furthermore, in the no-load operation control, shortening the pressure drop time period enables a drop in pressure on the outlet end of the compressor body to a lower level, resulting in a reduction in power during the process of pressure drop.

However, a quick drop in pressure inside the oil tank to around the atmospheric pressure causes occurrence of so-called foaming resulting from expansion of bubbles concentrated in the lubricating oil to generate larger bubbles.

The shorter the time of drop in pressure inside the oil tank, the faster the foaming grows. If the pressure drops sharply, a cluster of bubbles may possibly move upward in the tank and then through the oil separator to flow to the user.

To avoid this, Patent Literature 1 (Japanese Patent Application Laid-Open No. H05-296174) describes an oil supply type compressor configured to shorten the pressure drop time period and prevent the foaming.

CITATION LIST

Patent Literature

PTL 1: Japanese Patent Application Laid-Open No. H05-296174

SUMMARY OF INVENTION

Technical Problem

The foaming is described in detail. The lubricating oil, which has been separated by the oil separation mechanism in the oil tank and stored in the oil tank, includes fine bubbles concentrated by compression. In the automatic stopping control and the no-load operation control, the pressure inside the oil separator is reduced to the atmospheric pressure or nearly to the atmospheric pressure, and similarly, at this point, the pressure inside the oil tank reduces. Upon reduction of the pressure inside the oil tank to around the atmospheric pressure, the concentrated bubbles in the lubricating oil expands, causing foaming producing larger bubbles.

As described earlier, the shorter the time of drop in pressure inside the oil tank, the faster the foaming grows. If the pressure drops sharply, the cluster of produced bubbles may possibly move upward in the oil tank and pass through the oil separator to flow to the user.

As a measure to address the foaming, an increase in size of the oil tank may be taken into account. However, there is a trend toward a reduction in size of the oil tank in step with a reduction in materials cost and downsizing. This makes the oil tank smaller in internal capacity, reducing the volume holding the produced bubbles. For this reason, there is a necessity to provide an orifice in the air release piping so that the diameter of the orifice is decreased in order to set a longer duration of the pressure drop time, that is, the air release time.

Accordingly, there is a technical problem in the automatic stopping control that the limited time from stop to restart is longer to make it impossible to supply the compressed air swiftly in response to the load changes on the user side. There also is a technical problem in the no-load operation control that a longer period of the pressure drop time causes a delay in pressure drop on the outlet side of the compressor body, increasing the power required in the process of the pressure drop.

One described in Patent Literature 1 as described above is suggested as a solution to the technical problems. Patent Literature 1 describes that, until a pressure at which foaming increases steeply, the flow rate of air release of the compressed air in the oil separator is increased to shorten the air release time period, and then, upon reduction below the pressure at which foaming increases steeply, from that point on, the flow rate of air release is decreased so as to reduce the pressure at a slow pace in order to shorten the air release time period and a reduction of the amount of foaming occurring.

In Patent Literature 1, for the control of the flow rate of release air to shorten the air release time period and reduce the amount of foaming occurring, switching from large cross-sectional area to small cross-sectional area of a flow passage of the air release piping is required during the air release process. In the use of the orifice, switching from a larger diameter to a smaller diameter of the orifice is required.

If the cross-sectional area of the flow passage of the air release piping is decreased or the small-diameter orifice is used, this results in a factor in causing clogging due to foreign matter and/or a trace oil content included in the compressed air to be released. If clogging occurs in the orifice, the air releasing function is hindered, so that, in the automatic stopping control of the compressor, the compressed air in the oil separator is not sufficiently released to leave the residue. At the subsequent restart, this residual pressure brings about startup stall, that is, a state of incapability of acceleration due to insufficient torque of the motor driving the compressor body.

It is desired to provide an oil supply type compressor capable of preventing foaming from occurring in an oil separation device during capacity control in the compressor while shortening the pressure drop time period, and also avoiding startup stall to achieve a normal startup.

Solution to Problem

To address the above-described technical problems, for example, claim 1 of the invention is applied. Specifically, an oil supply type compressor includes: a compressor body compressing air; an oil separation device separating lubricating oil from the compressed air compressed by the compressor body; piping for supplying, to a user side, the compressed air after flowing through the oil separation device; and an air release path for releasing the compressed air after flowing through the oil separation device in capacity control for the compressor. In the oil supply type compressor, the air release path includes a high flow-rate flow path and a low flow-rate flow path; in the capacity control for the compressor, when the compressed air in the oil separation device is released through the air release path into the atmosphere, the high flow-rate flow path is used for air release until a pressure in the oil separation device becomes equal to or less than a restarting-possible pressure at which startup stall is not caused when the compressor body is restarted; and the low flow-rate flow path is used for air release when a pressure in the oil separation device reaches a predetermined pressure which is equal to or less than the restarting-possible pressure and also exceeds a foaming pressure at which foaming occurs due to a fast reduction in pressure in the oil separation device.

According to another aspect, an oil supply type compressor includes: a compressor body compressing air; an oil separation device separating lubricating oil from the compressed air compressed by the compressor body; piping for supplying, to a user side, the compressed air after flowing through the oil separation device; and an air release path for releasing the compressed air after flowing through the oil separation device in capacity control for the compressor. In the oil supply type compressor, the air release path has a flow-passage cross-sectional area determined to allow for a flow at high flow rate causing a slope of pressure drop at which foaming occurs due to a fast reduction in pressure in the oil separation device; and in the capacity control for the compressor, when the compressed air in the oil separation device is released through the air release path into the atmosphere, the air release path is closed when a pressure in the oil separation device reaches a predetermined pressure that is equal to or less than a restarting-possible pressure at which startup stall is not caused when the compressor body is restarted, and also that exceeds a foaming pressure at which foaming occurs due to a fast reduction in pressure in the oil separation device.

Advantageous Effects of Invention

According to the present invention, in the oil supply type compressor, foaming is prevented in an oil separation device during capacity control in the compressor, while the pressure drop time period is shortened. Further startup stall is avoided to achieve a normal startup.

DESCRIPTION OF EMBODIMENTS

Concrete examples of an oil supply type compressor according to the present invention will be described below with reference to the accompanying drawings. In the respective drawings, parts designated by the same reference signs are shown as the same parts or corresponding parts.

Example 1

As an example of application to an oil-supply-type screw compressor, Example 1 of the oil supply type compressor according to the present invention will be described with reference to FIG. 1 to FIG. 4.

Figure 1:
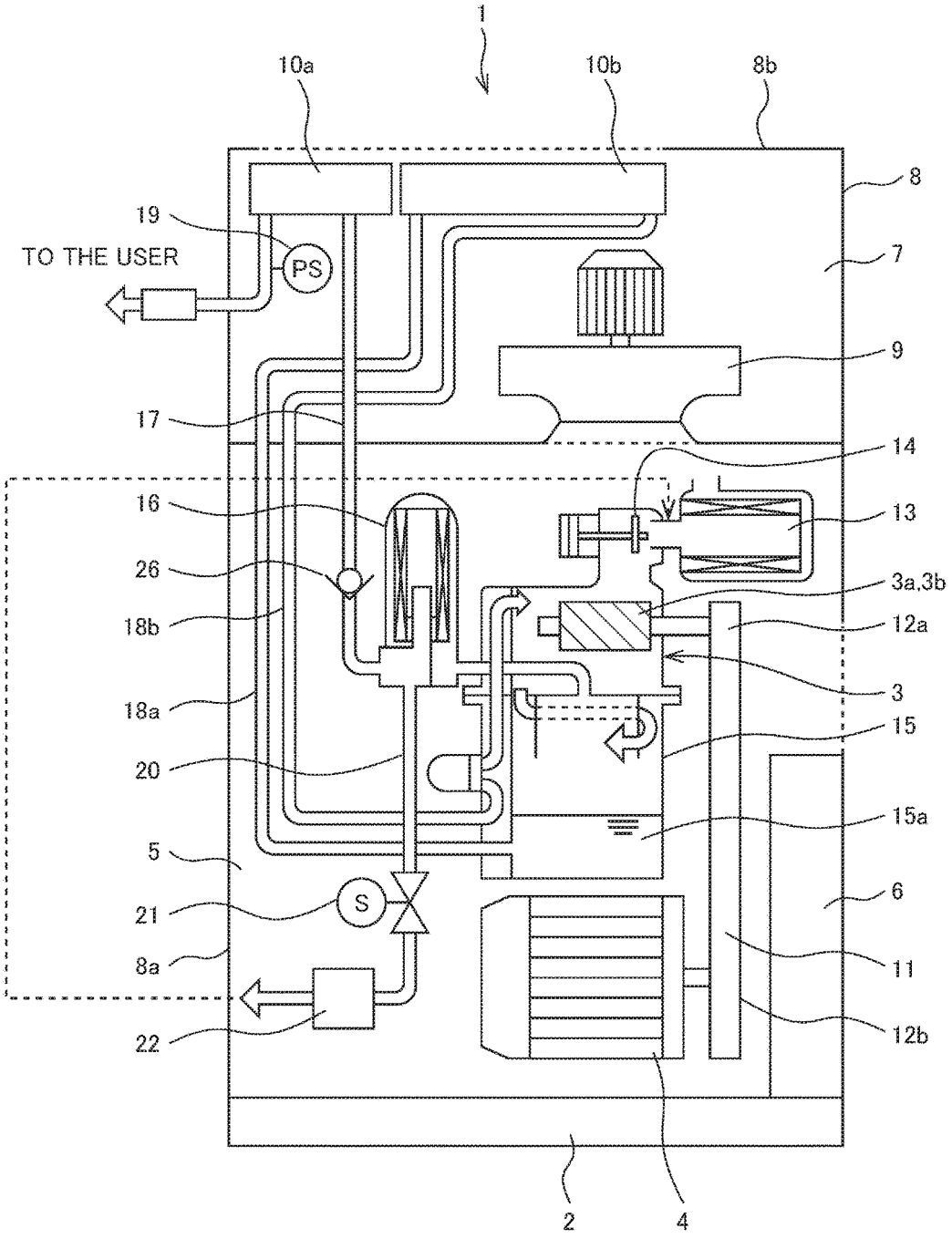
FIG. 1 is a schematic block diagram illustrating Example 1 of an oil supply type compressor according to the present invention.

The overall structure of the oil-supply-type screw compressor according to Example 1 is described using FIG. 1.

The oil-supply-type screw compressor (hereinafter referred to simply as the "compressor") 1 illustrated in FIG. 1, which produces compressed air, is structured in package form. The package-scheme, oil-supply-type screw compressor 1 includes a base 2 serving as a foundation and a package 8 mounted on the base 2. The inside of the package 8 is divided into a lower portion for a machine room 5 and an upper portion for a cooling room 7. The package 8 includes sound insulation covers 8*a*, 8*b* for preventing noise propagation to outside of the compressor.

In the machine room 5, a compressor body 3 producing compressed air, a motor 4 driving the compressor body 3, an electric case 6 holding electric parts, and the like, are mounted on the base 2. Also, the cooling room 7 has mounted in it an air cooler 10*a* for cooling the compressed air compressed by the compressed body 3, an oil cooler 10*b* for cooling lubricating oil separated from the compressed air, a cooling fan sucking air from the machine room 5 and blowing cooled air into the air cooler 10*a* and/or the oil cooler 10*b*, and the like. The cooling fan 9 also has the job of introducing outside air into the machine room 5 to cool the compressor body 3, the motor 4 and the like located in the machine room 5.

The driving force of the motor 4 is transferred to rotors 3*a*, 3*b* of the compressor body 3 via a belt 11 and pulleys 12*a*, 12*b*. Therefore, the compressor body 3 is configured to take in air from the inside of the machine room 5 for compression.

The compressor body 3 has a pair of male and female rotors (screw rotors) 3*a*, 3*b*, in which the air in the machine room 5 is taken in through an intake filter 13 and an intake throttle valve 14, and the intake air is compressed by rotating the rotors 3*a*, 3*b*.

The lubricating oil is injected into the compressor body 3 for cooling of the rotors 3*a*, 3*b* and a seal between the rotors 3*a*, 3*b*. Thus, the compressed air compressed by the rotors 3*a*, 3*b* is discharged with being mixed with the injected lubricating oil, and then introduced into the oil tank 15. In the oil tank 15, the lubricating oil is separated from the compressed air by use of centrifugal force and/or collision. The compressed air from which the lubricating oil is separated flows then into an oil separator 16 where the lubricating oil is further separated by a filtering element. The compressed air from which the lubricating oil is thus separated is delivered into the air cooler 10*a* through piping 17 to be cooled, which is then supplied to a reservoir and/or the like on the user side from which the compressed air is supplied to a required site.

The lubricating oil separated from the compressed air is stored in the oil tank 15. A pressure difference between a primary side (inlet side) and a secondary side (outlet side) of the rotors 3*a*, 3*b* is used to deliver the lubricating oil 15*a* in the oil tank 15 into the oil cooler 10*b* via piping 18*a* to cool the lubricating oil. The lubricating oil thus cooled is delivered to the compressor body 3 again via piping 18*b*, and then injected toward the rotors 3*a*, 3*b* again.

An air release piping 20 having a solenoid valve 21 and a quick air release valve 22 is connected to a downstream side of the oil separator 16. In the example, as shown by dotted lines in FIG. 1, the air release piping 20 is connected to an upstream side of the intake throttle valve 14. Thus, the air to be released can be released by way of the intake filter 13, and also the compressed air to be released is able to be used for a drive source of closing the intake throttle valve 14.

The compressed-air pressure on the user side is detected by a pressure sensor 19 installed downstream of the air cooler 10*a*, and the solenoid valve 21 is opened/closed in response to a detected pressure.

Specifically, when the user-side air pressure detected by the pressure sensor 19 reaches a predetermined upper-limit pressure, the solenoid valve 21 is opened, so that the operation for the compressor is switched from the normal operation to the automatic stopping control or the no-load operation control. This action is described in further detail.

During normal operation, the solenoid valve 21 is closed, so that all the compressed air passing through the oil separator 16 flows toward the user. Then, when the amount of air usage on the user side is reduced and the user-side air pressure detected by the pressure sensor 19 reaches a predetermined upper-limit pressure, the solenoid valve 21 is opened so that the operation for the compressor is switched from the normal operation to the no-load operation control or the automatic stopping control.

In most cases, switching to the no-load operation control is first made. Then, the amount of air usage on the user side becomes very low, and then the amount of air usage reaches zero or near zero, switching from the no-load operation control to the automatic stopping control is made. However, the operation for the compressor may be switched from the normal operation directly to the automatic stopping control with bypassing the no-load operation control.

In the no-load operation control, the intake throttle valve 14 is closed and the solenoid valve 21 is opened, so that the compressed air on the downstream side of the oil separator 16 flows through the solenoid valve 21 toward the quick air release valve 22 arranged downstream of the solenoid valve 21. The cross-sectional area of the flow passage in the quick air release valve 22 is adjusted with an orifice or the like, such that the compressed air at a flow rate corresponding to the flow-passage cross-sectional area thus adjusted is released into the machine room 5 (released via the upstream side of the intake throttle valve 14 into the machine room 5 in the example).

At this stage, in order to prevent an outflow of the compressed air on the user side from the downstream sided of the oil separator 16 via the air release piping 20, a check valve 26 is installed downstream of the oil separator 16.

In the no-load operation control, rotation of the rotors 3*a*, 3*b* is maintained. When the user-side air pressure detected by the pressure sensor 19 reaches a predetermined lower-limit pressure, the solenoid valve 21 is closed, so that switching from the no-load operation control to the normal operation is made for the compressor.

In the automatic stopping control, likewise, the intake throttle valve 14 is closed and the solenoid valve 21 is opened, so that the compressed air on the downstream side of the oil separator 16 flows through the solenoid valve 21 toward the quick air release valve 22 installed downstream of the solenoid valve 21, which is then released into the machine chamber 5 after the adjustment to the flow rate has been made in the quick air release valve 22.

In the automatic stopping control, the rotation of the rotors 3*a*, 3*b* is stopped. When the user-side air pressure detected by the pressure sensor 19 reaches the predetermined lower-limit pressure, the solenoid valve 21 is closed and switching from the automatic stopping control to the normal operation is made for the compressor.

In the automatic stopping control, the intake throttle valve 14 is closed to prevent the lubricating oil from flowing toward the intake filter 13, such that the rotors 3*a*, 3*b* are not rotated in the opposite direction by the pressure inside the compressor body 3.

The structure and the operation of the quick air release valve 22 installed in the air release piping 20 shown in FIG. 1 will now be described in detail with reference to FIG. 2 and FIG. 3.

The quick air release valve 22 includes a valve body 23, a flow-passage entrance 23*a* connected with the solenoid valve 21, and a first flow-passage exit 23*b* and a second flow-passage exit 23*c* which are connected with the atmosphere. Further, a larger-diameter orifice 23*d* with the large cross-sectional area of the flow passage is arranged in the second flow-passage exit 23*c*. In addition, a linear-shaped inner flow passage 23*e* is formed for connection between the flow-passage entrance 23*a* and the first flow-passage exit 23*b*, and the second flow-passage exit 23*c* is located orthogonally to the inner flow passage 23*e*.

A piston 24 is located in the inner flow passage 23*e* to reciprocate between the flow-passage entrance 23*a* and the first flow-passage exit 23*b*. In the inside of the piston 24, a smaller-diameter orifice 24*a* with a smaller cross-sectional area of the flow passage than that of the larger-diameter orifice 23*d* is formed to communicate with the flow-passage entrance 23*a* and the first flow-passage exit 23*b*.

Further, a spring 25 is located in the inner flow passage 23*e* to press the piston 24 toward the flow-passage entrance 23*a*. During normal operation, the piston 24 is pressed toward the flow-passage entrance 23*a* by the spring 25, in which the outer periphery of the piston 24 is pressed against the valve body 23 or a member forming the flow-passage entrance to create the sealed state.

The inner flow passage 23*e* has a larger diameter portion 23*e*1 formed at the entrance end to have a larger diameter than the outside diameter of the piston 24, and also a smaller diameter portion 23*e*2 formed at the exit end to have a slightly larger than the outside diameter of the piston 24. The second flow-passage exit 23*c* is formed in a position communicating with the larger diameter portion 23*e*1. The piston 24 also slides in the smaller diameter portion 23*e*2 to reciprocate. An O ring 27 is mounted to seal between the piston 24 and the inner passage 23*e*.

The operation of the above-described quick air release valve 22 will now be described. In the description of the operation, an example of the oil supply type compressor 1 under normal operation and an example of the oil supply type compressor 1 under automatic stopping control are described.

In the normal operation of the compressor, the solenoid valve 21 in the air release piping 20 is closed. Therefore, the flow-passage entrance 23*a* is under atmospheric pressure, and the piston 24 is in the state of being pressed toward the flow-passage entrance 23*a* by the spring 25 (the state shown in FIG. 2).

The automatic stopping control is executed when the amount of air usage on the user side decreases and the compressed-air pressure detected by the pressure sensor 19 reaches the upper-limit pressure P1. In the automatic stopping control, the motor 4 is stopped and also the compressor body 4 is stopped. Simultaneously, the solenoid valve 21 is opened, so that the compressed air flows into the flow-passage entrance 23*a* of the quick air release valve 22 from the exit of the oil separator 16, and the pressure of the compressed air acts on the end face of the piston 24 to press the piston 24 toward the first flow-passage exit 23*b* against the spring 25. When the force of the compressed air pushing the piston 24 increases to exceed the force of the spring 25 pushing the piston 24, the piston 24 moves toward the first flow-passage exit 23*b* (the state shown in FIG. 3). This causes the compressed air in the oil separator 16 and the oil tank 15 to flow through both the smaller-diameter orifice 24*a* and the larger-diameter orifice 23*d*, thereby releasing a high volume of the compressed air into the atmosphere, resulting in a quick drop in pressure inside the oil tank 15.

Then, a drop in compressed air pressure inside the oil separator 16 and the oil tank 15 causes a gradual reduction in the force of the compressed air pressing the piston 24. Then, when the force of the compressed air pressing the piston 24 becomes less than the force of the spring 25 pressing the piston 24, the spring force moves the piston 24 toward the flow-passage entrance 23*a* (the state shown in FIG. 2). Upon a change to the state in FIG. 2, the compressed air inside the oil separator 16 and the oil tank 15 is released only through the smaller-diameter orifice 24*a* to the atmosphere, resulting in a slow drop in pressure inside the oil tank 15.

Figure 4:
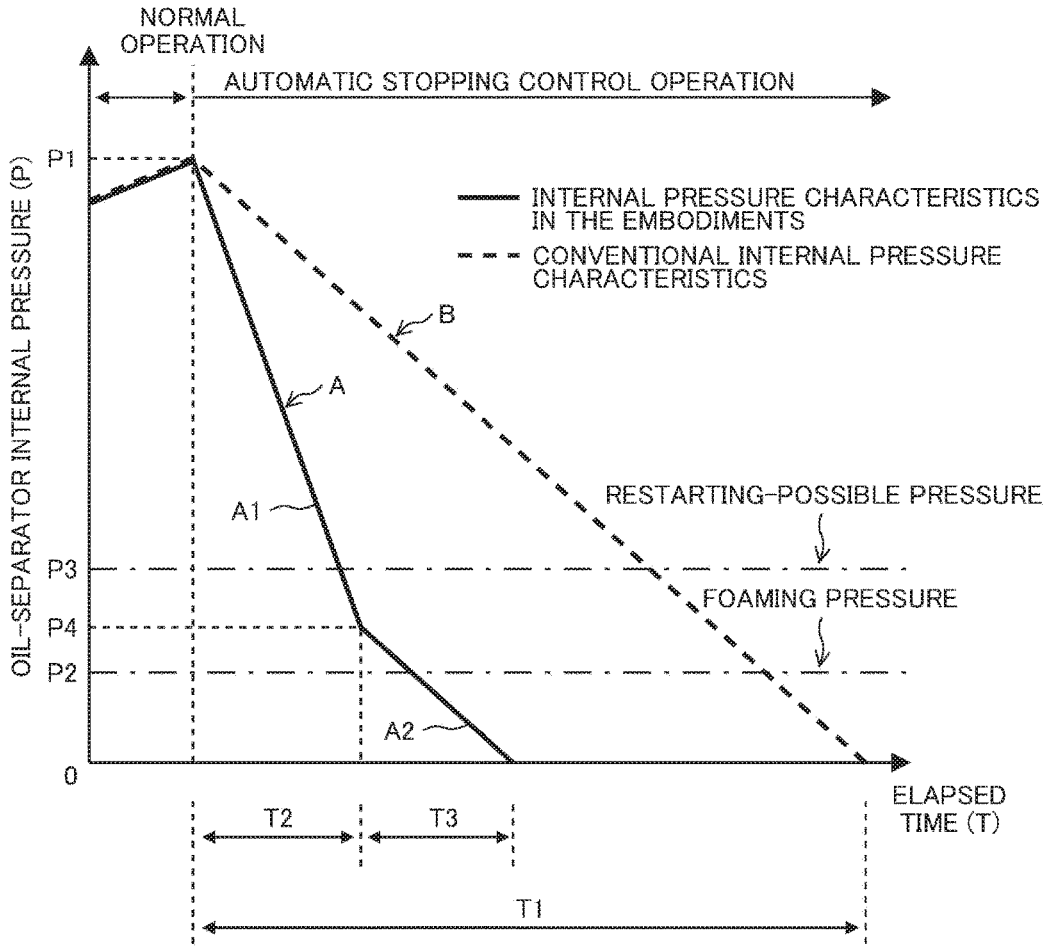
FIG. 4 is a line graph describing the internal pressure characteristics of an oil separator during an automatic stopping control according to Example 1 of the present invention.

The above operation is described based on FIG. 4. FIG. 4 is a line graph showing oil-separator internal-pressure characteristics in the automatic stopping control in the compressor. In FIG. 4, the horizontal axis represents elapsed time and the vertical axis represents internal pressure of the oil separator 16.

Pressure P1 on the vertical axis indicates an upper limit value of air pressure on the user side (upper-limit pressure, corresponding to the pressure at which, when the user-side air pressure reaches the upper-limit pressure P1, switching from normal operation to the automatic stopping control or the no-load operation control is made for the compressor 1. Pressure P2 on the vertical axis corresponds to the pressure at which foaming is caused by a quick drop in pressure inside the oil tank 15 (foaming pressure). Pressure P3 corresponds to the pressure at which, at restart, the compressor 1 is able to be restarted without startup stall. Pressure P4 corresponds to the pressure at which switching to a small flow rate of air release using only a narrower flow passage of small flow-passage cross-sectional area (smaller-diameter orifice) is made (switching-to-small air release rate pressure).

Further, solid line A in the line graph shows the oil-separator internal pressure characteristics in the example, dotted line B shows the oil-separator internal pressure characteristics in a conventional compressor with only a small-diameter orifice. Time T1 on the horizontal axis in FIG. 4 represents time required for the oil-separator internal pressure to reduce from the upper-limit pressure P1 to the atmospheric pressure (P=0) in the automatic stopping control in the conventional compressor. Time T2 represents time required for the oil-separator internal pressure to reduce the upper-limit pressure P1 to the switching-to-small air release rate pressure P4 in the example, while time T3 represents time required to reduce from the switching-to-small small air release rate pressure P4 to the atmospheric pressure (P=0).

Upon startup of the compressor 1, initially, the normal operation is performed. During the normal operation, when reducing the amount of air usage on the user side causes a compressed-air pressure detected by the pressure sensor 19 to reach the upper-limit pressure P1, the compressor 1 goes into the automatic stopping control operation to stop the motor 4 to stop the compressor body 3. Upon entry into the automatic stopping control, the solenoid valve 21 is opened, so that the compressed air flows from the exit of the oil separator 16 into the flow-passage entrance 23*a* of the quick air release valve 22, to move the piston 24 toward the first flow-passage exit 23*b* (the state shown in FIG. 3). As a result, the compressed air inside the oil separator 16 and the oil tank 15 passes through both the smaller-diameter orifice 24*a* and the larger-diameter orifice 23*d* to be voluminously released into the atmosphere. Because of this, the internal pressure P of the oil separator 16 rapidly reduces as shown by portion A1 of the solid line A (likewise the pressure in the oil tank 15 reduces).

Figure 2:
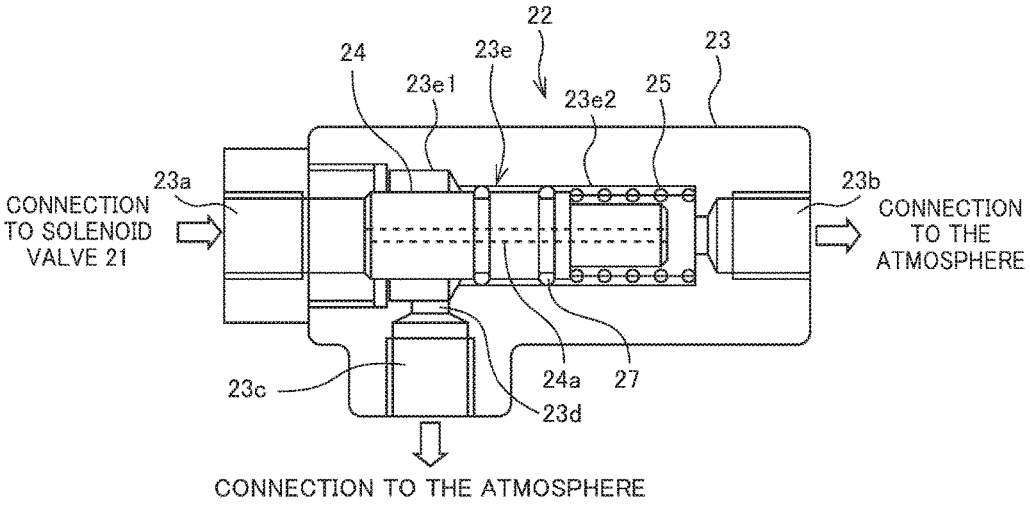
FIG. 2 is a vertical section view illustrating the structure of a quick air release valve shown in FIG. 1.
Figure 3:
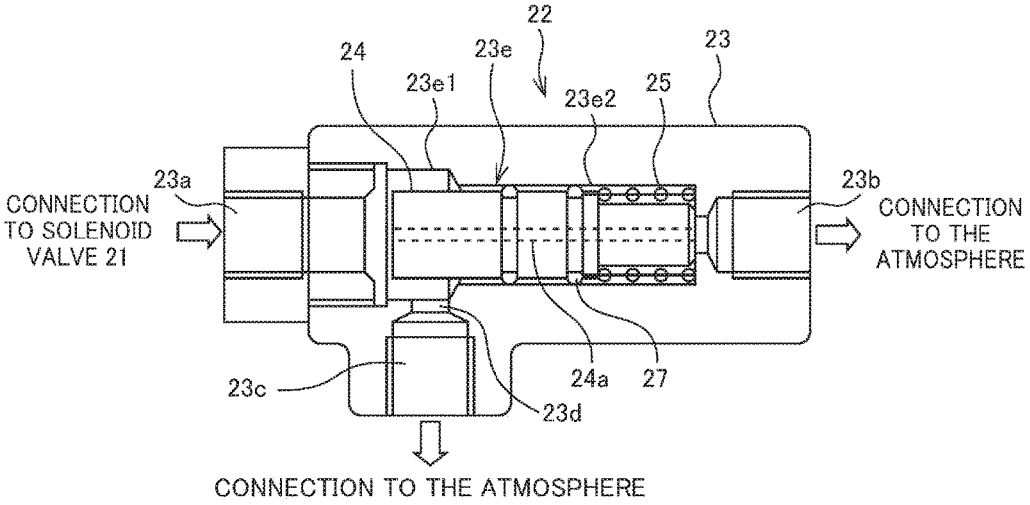
FIG. 3 is a vertical section view illustrating the operation of the quick air release valve shown in FIG. 1.

Then, when the internal pressure P of the oil separator reduces to a predetermined pressure (the switching-to-small air release rate pressure P4) that is lower than the restart-possible pressure P3 and also higher than the foaming pressure P2, the spring 25 moves the piston 24 toward the flow-passage entrance 23*a* (the state shown in FIG. 2). Thereby, the compressed air is released through only the smaller-diameter orifice 24*a* into the atmosphere. Accordingly, the amount of air release is smaller, so that the pressure in the oil separator 16 slowly reduces as shown by portion A2 of the solid line A. Thus, prevention of foaming is achieved.

In the example, until the pressure on the oil separator 16 side becomes equal to or less than the restarting-possible pressure P3, both the larger-diameter orifice 23*d* and the smaller-diameter orifice 24*a* are used to release high volume of the compressed air. Because of this, a drop in pressure to be equal to or less than the restarting-possible pressure P3 is able to be achieved for a shorter time. As a result, the limited time to the subsequent restart can be shortened, leading to a quicker supply of compressed air in response to changes in load on the user side.

Furthermore, avoidance of startup stall at restart can be ensured to enable normal startup at all times by means of setting the limited time to the subsequent restart such that the pressure on the oil separator 16 side becomes equal to or less than the restarting-possible pressure P3 or of restarting after pressure on the oil separator 16 side is detected and the detected pressure becomes the restarting-possible pressure P3.

Further, according to the example, even if a portion of small flow-passage cross-sectional area in the air release path (e.g., the smaller-diameter orifice 24*a*) is blocked (clogged) by foreign matter, a portion of large flow-passage cross-sectional area (e.g., the larger-diameter orifice 23*d*) is not blocked by foreign matter in most cases. Thus, the compressed air is capable of being released for a short time through the portion of large flow-passage cross-sectional area until the pressure becomes equal to or less than the restarting-possible pressure P3. As a result, occurrence of startup stall at restart can be avoided with reliability to provide normal startup.

To realize the above-described operation, in the example, strength of the spring 25 installed in the quick air release valve 22 is set as follows. Specifically, the strength is set such that the piston 24 moves rightward against the pressing force of the spring 25 as shown in FIG. 3 to activate the opening when the oil-separator internal pressure reaches a pressure equal to or less than the restarting-possible pressure P3 and also equal to or greater than the foaming pressure P2, establishing communication between the flow-passage entrance 23*a* and the second flow-passage exit 23*c*.

The smaller-diameter orifice 24*a* (the portion of small flow-passage cross-sectional area) is formed to have a bore diameter (flow-passage cross-sectional area) such that a slope of pressure drop is plotted to prevent the foaming.

The example has been described of the case of switching from normal operation to the automatic stopping control operation, but the example is applicable to even the case of also having a no-load operation control function and performing the no-load operation control. Specifically, in the no-load operation control, except a difference of performing the no-load operation control while maintaining the operation of the compressor body, the same control is performed to close the intake throttle valve on the inlet side of the compressor to release the compressed air passing through the oil separator into the atmosphere, which is similar to that described in FIG. 4.

Then, in the no-load operation control, similarly, shortening the time required to reduce the pressure inside the oil separator to atmospheric pressure (pressure drop time period) enables a faster drop in pressure on the outlet side of the compressor body, resulting in the effect of reducing the power in the pressure drop process. Further, there is an effect that, even if the portion of small flow-passage cross-sectional area in the air release piping (the smaller-diameter orifice) is clogged with foreign matter, the pressure on the outlet side of the compressor body is quickly reduced to perform the no-load operation control. In addition, similarly to the aforementioned automatic stopping control, foaming during the no-load operation control for the compressor can be avoided.

According to the example described above, in the capacity control for the compressor (the automatic stopping control and the no-load operation control), for releasing the compressed air inside the oil separation device (the oil separator, oil tank and the like) into the atmosphere, the compressed air is released through the larger-diameter orifice or through both the larger-diameter orifice and the smaller-diameter orifice until the pressure inside the oil separation device becomes equal to or less than the restarting-possible pressure. Then, the pressure inside the oil separation device reaches a predetermined pressure equal to or less than the restarting-possible pressure and also exceeding the foaming pressure, the compressed air is released through the smaller diameter orifice alone. This significantly shortens the time required to release the compressed air inside the oil separator (pressure drop time period) while preventing foaming. As a result, shortening of the limited time to restart in the automatic stopping control can be achieved, and also normal startup can be provided by avoiding startup stall at restart with reliability.

In the no-load operation control, similarly, because the time required to drop the pressure inside the oil separation device is shortened, the effect of reducing the power in the pressure drop process is produced.

Further, even in the event of clogging of the smaller-diameter orifice with foreign matter, the larger-diameter orifice is able to be used to release the compressed air for a short time until the pressure equal to or less than the restarting-possible pressure is reached, resulting in an oil supply type compressor capable of avoiding occurrence of startup stall at restart with reliability for normal startup.

The above-described example has been described of the case of providing the larger-diameter orifice and the smaller-diameter orifice in the air release path, but not be limited to. As long as the flow rate of air release can be controlled by using large flow-passage cross-sectional area (high flow-rate flow path) and small flow-passage cross-sectional area (low flow-rate flow path), such alternatives may be employed.

Without providing the smaller-diameter orifice (low flow-rate flow path), using the larger-diameter orifice (high flow-rate flow path) alone is possible. In this case, the air release path is configured to have the flow-passage cross-sectional area determined to allow a flow at high flow rate at which a slope of pressure drop is plotted to produce foaming due to a quick drop in pressure inside the oil separation device. Then, in the capacity control of the compressor, in the process of releasing the compressed air inside the oil separation device through the air release path into the atmosphere, the air release path is configured to be closed when the pressure inside the oil separation device reaches a predetermined pressure that is equal to or less than a restarting-possible pressure at which startup stall is not caused at the time of restarting the compressor body and also that exceeds a foaming pressure at which foaming occurs due to a fast drop in pressure inside the oil separation device.

With the configuration as described above, in like manner, the air-release time required to release the compressed air inside the oil separator is able to be significantly reduced while preventing foaming, thus achieving a reduction in limited time until restart in the automatic stopping control. In the no-load operation control, because the time required to reduce the pressure in the oil separation device can be shortened, the effect of reducing the power in the pressure drop process is obtained. In addition, because a low flow-rate flow path is unnecessary, prevention of clogging can be achieved with simple structure.

The example has been described of the compressor having both the functions of the automatic stopping control and the no-load operation control as the capacity control for the compressor, but the present invention is similarly applicable to a compressor having only the automatic stopping control and similar effects can be produced.

It should be understood that the present invention is not limited to the disclosed example, but is intended to cover various modifications. For example, in the example, the oil-supply-type screw compressor as the oil supply type compressor has been described by way of illustration, but such a compressor is not limited to the screw compressor, and as long as compressors release the compressed air inside the oil separation device in the capacity control, the present invention can be applied to any another scheme oil supply type compressor as well. Further, the disclosed example has been described in detail to explain the present invention in an easy-to-understand manner, but the present invention is not limited to ones that do not necessarily include all structures/arrangements described herein.

REFERENCE SIGNS LIST

1 . . . Oil supply type screw compressor (compressor),
2 . . . Base,
3 . . . Compressor body,
3*a*, 3*b* . . . Rotor,
4 . . . Motor,
5 . . . Machine room,
6 . . . Electric case,
7 . . . Cooling room,
8 . . . Package,
8*a*, 8*b* . . . Sound insulation cover,
9 . . . Cooling fan,
10*a* . . . Air cooler,
10*b* . . . Oil cooler,
11 . . . Belt,
12*a*, 12*b* . . . Pulley,
13 . . . Intake filter,
14 . . . Intake throttle valve,
15, 16 . . . Oil separation device (15 . . . Oil tank, 15*a* . . . Lubricating oil, 16 . . . Oil separator),
17, 18*a*, 18*b* . . . Piping,
19 . . . Pressor sensor,
20 . . . Air-release piping,
21 . . . Solenoid valve (on/off valve),
22 . . . Quick air release valve,
23 . . . Valve body,
23*a* . . . Flow-passage entrance,
23*b* . . . First flow-passage exit,
23*c* . . . Second flow-passage exit,
23*d* . . . Larger-diameter orifice (high flow-rate flow path),
23*e* . . . Inner flow passage,
23*e*1 . . . Larger diameter portion,
23*e*2 . . . Smaller diameter portion,
24 . . . Piston,
24*a* . . . Smaller-diameter orifice (low flow-rate flow path),
25 . . . Spring,
26 . . . Check valve,
27 . . . O ring.

The invention claimed is:

1. An oil supply type compressor, comprising:

a compressor body generating compressed air;

an oil separation device separating lubricating oil from the compressed air;

user side piping for supplying to a user side compressed air flowing from the oil separation device;

air release piping connected between the oil separation device and an intake throttle valve for releasing compressed air flowing from the oil separation device in a capacity control mode for the compressor; and an air release valve in the air release piping including a valve body with a flow passage entrance, a first flow exit arranged substantially coaxially with the flow passage entrance, and a second exit arranged substantially orthogonally relative to the flow passage entrance, as well as a piston movable within the valve body, wherein the piston directs air through both the first and second flow exits, thereby providing a first flow passage cross sectional area determined to allow for release of the compressed air at a first flow rate, when an oil separation device internal pressure is between a pressure upper limit on the user side and a switching pressure above an oil foaming pressure, and through only the first flow exit, thereby providing a second flow passage cross sectional area determined to allow for release of the compressed air at a second flow rate below the first flow rate, when the oil separator internal pressure is below the switching pressure.

2. The oil supply compressor according to claim 1, wherein the compressor is a screw compressor.

* * * * *